US005649988A

United States Patent [19]

Valle et al.

[11] Patent Number: 5,649,988

[45] Date of Patent: Jul. 22, 1997

[54] METHOD FOR CONDITIONING GLASS BEADS

[75] Inventors: Moises A. Valle, Tustin Ranch, Calif.; Karl Lehner, Munich, Germany

[73] Assignee: Chiron Vision Corporation, Claremont, Calif.

[21] Appl. No.: 480,776

[22] Filed: Jun. 7, 1995

Related U.S. Application Data

[63] Continuation of Ser. No. 221,765, Mar. 30, 1994, abandoned, continuation-in-part of PCT/US92/08605 Oct. 9, 1992, which is a continuation-in-part of Ser. No. 78,285, Jun. 27, 1994, Pat. No. 5,571,558, which is a continuation of Ser. No. 775,648, Oct. 10, 1991, abandoned.

[51] Int. Cl.[6] ..... C03B 35/00

[52] U.S. Cl. ..... 65/35; 65/21.1; 65/60.5; 427/215

[58] Field of Search ..... 65/21.1, 21.3, 65/21.5, 60.5, 35; 427/215

[56] References Cited

U.S. PATENT DOCUMENTS

| | | | |
|---|---|---|---|
| 2,084,427 | 6/1937 | Broderson | 18/47.5 |
| 2,380,653 | 7/1945 | Kopplin | 51/282 |
| 2,387,034 | 9/1945 | Milano | 18/47.5 |
| 2,947,124 | 8/1960 | Madigan et al. | 51/282 |
| 3,030,746 | 10/1962 | Firestine et al. | 51/284 |
| 3,656,921 | 4/1972 | Willcox | 65/2.1 |
| 3,816,107 | 6/1974 | Searight et al. | 65/30 |
| 3,876,450 | 4/1975 | Tanner | 117/54 |
| 4,485,061 | 11/1984 | Akhavi et al. | 264/161 |
| 4,541,206 | 9/1985 | Akhavi | 51/217 |
| 4,551,949 | 11/1985 | Akhavi et al. | 51/164.1 |
| 4,580,371 | 4/1986 | Akhavi | 51/313 |
| 4,668,446 | 5/1987 | Kaplan | 264/1.7 |
| 4,856,234 | 8/1989 | Goins | 51/284 |
| 4,911,190 | 3/1990 | Sheldon | 134/85 |
| 5,074,908 | 12/1991 | Boswell et al. | 75/352 |
| 5,104,590 | 4/1992 | Blake | 264/2.5 |
| 5,133,159 | 7/1992 | Nelson | 51/313 |
| 5,185,107 | 2/1993 | Blake | 264/2.5 |
| 5,249,395 | 10/1993 | Yoshida . | |
| 5,378,499 | 1/1995 | Martin et al. . | |
| 5,571,558 | 11/1996 | Nguyen et al. | 427/215 |

FOREIGN PATENT DOCUMENTS

WO93/06967 4/1953 WIPO .

*Primary Examiner*—Donald E. Czaja
*Assistant Examiner*—Jacqueline A. Ruller
*Attorney, Agent, or Firm*—Loeb & Loeb LLP

[57] ABSTRACT

A process of removing flash from a molded silicone intraocular lens includes a step of tumbling (grinding) the lens body in a tumbling media. The tumbling media includes conditioned 0.5 mm diameter glass beads or a mixture of 0.5 mm and 0.3 mm diameter glass beads, alcohol and water. This process applies to single piece and multipiece silicone IOLs.

28 Claims, 2 Drawing Sheets

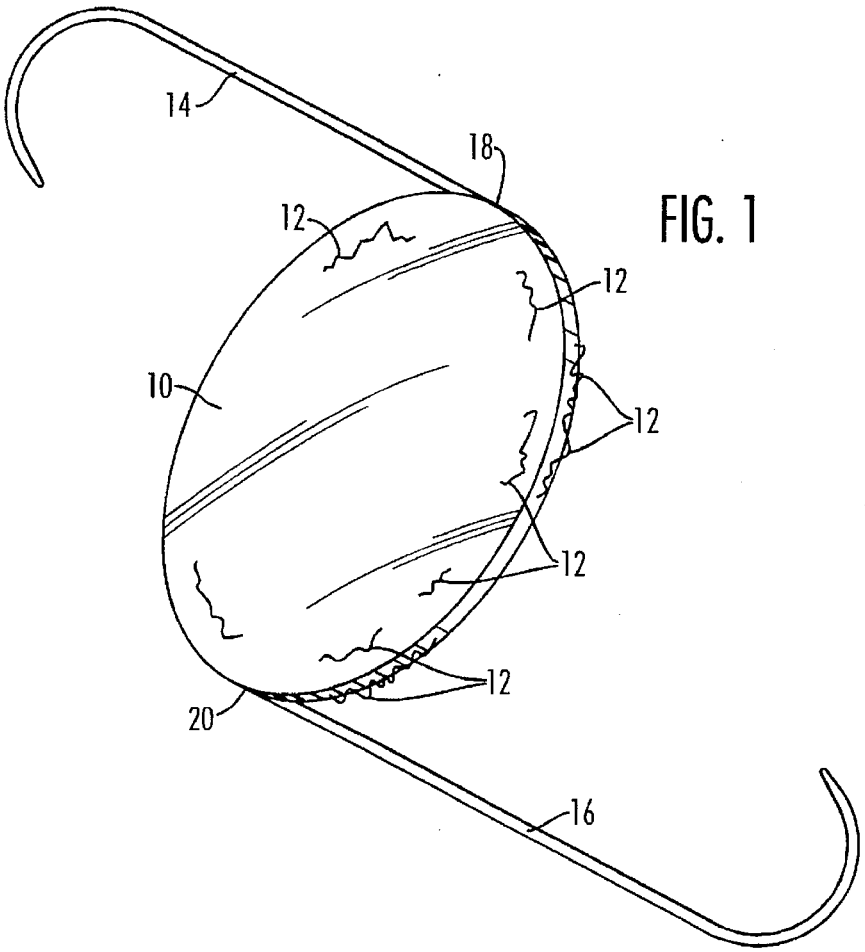
FIG. 1
FIG. 2
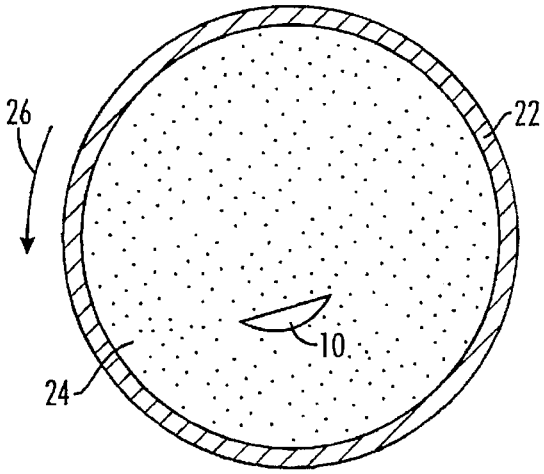
FIG. 3
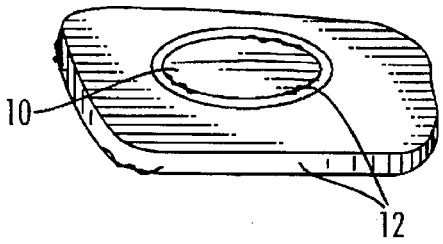

METHOD FOR CONDITIONING GLASS BEADS

RELATED APPLICATIONS

The present application is a continuation of U.S. application Ser. No. 08/221,765 filed Mar. 30, 1994 (abandoned) which is a continuation in part of International Application Number PCT/US92/08605 filed Oct. 9, 1992, national stage of U.S. application Ser. No. 08/078,285 filed Jun. 27, 1994, (now U.S. Pat. No. 5,571,558) which is a continuation of U.S. Application Ser. No. 07/775,648, filed Oct. 10, 1991, (abandoned), all of which are assigned to the assignee of the present application.

BACKGROUND of the INVENTION

1. Field of the Invention

The present invention relates to manufacturing processes for intraocular lenses (IOLs), tumbling processes used in the manufacture of molded IOLs and IOLs manufactured with the processes.

2. Related Art

Methods of molding articles from a moldable material, such as plastic, have been practiced for quite some time. A common problem associated with molding processes is the formation of excess material or flash on the molded article. Depending upon the type article formed in the molding process and the manner in which the article is used, the existence of excess material or flash can be undesirable.

Prior methods of removing flash from molded articles include such labor intensive processes as cutting the flash with a blade or scissors. However, such cutting methods can be extremely time consuming and expensive, especially when a large number of articles are being manufactured.

Methods of removing flash by tumbling the molded article in a rotatable tumbling container have been successfully practiced. For example, U.S. Pat. No. 2,084,427 to Boderson and U.S. Pat. No. 2,387,034 to Milano describe methods of making plastic articles, buttons in particular, which include steps of tumbling the articles to remove projections of excess material or flash. Similarly, U.S. Pat. No. 4,485,061 to Akhavi et al. describes a method of processing plastic filaments which includes "abrasive tumbling" to remove excess material.

A cold temperature tumbling process is described in U.S. Pat. No. 2,380,653 to Kopplin. According to this method, flash is removed from a molded article by tumbling the article in a rotatable container of dry ice and small objects, such as wooden pegs. The cold temperature resulting from the dry ice renders the flash material relatively brittle, such that the flash is more easily broken off of the article during the tumbling process.

U.S. Pat. No. 3,030,646 to Firestine, et al. describes a grinding and polishing method for optical glass, including glass lenses. The method includes a tumbling process wherein the glass articles are placed in a composition of a liquid, and abrasive and small pellets or media. The liquid is described as being water, glycerine, kerosine, light mineral oil and other organic liquids either alone or in combination; the abrasive is described as being garnet, corundum, boron carbide, cortz, aluminum oxide, emery or silicone carbide; and the media is described as being ceramic cones, plastic slugs, plastic molding, powder, limestone, synthetic aluminum oxide chips, maple shoe pegs, soft steel diagonals, felt, leather, corn cobs, cork or waxes.

Another example of a tumbling process used in the manufacture of optical lenses (including certain types of intraocular lenses) is described in U.S. Pat. No. 4,541,206 to Akhavi and U.S. Pat. No. 4,580,371, also to Akhavi. These patents describe a lens holder or fixture used for holding a lens in a process of rounding the edge of an optical lens. The process includes an "abrasive tumbling" step carried out with an "abrasive medium" 70 in a tumbler 72.

Prior methods of removing flash, such as described above, may be inadequate or impractical in the manufacture of certain types of intraocular lenses (IOLs). For example, certain modern IOLs are formed with a relatively soft, highly flexible material, such as a silicone material (e.g., Silicone "RMX-3" or "RMX-3UV"), which is susceptible to chemical and/or physical changes when subjected to cold temperatures. Therefore, certain types of cryo-tumbling (or cold temperature tumbling) may be impractical in the manufacture of lenses made from such soft lens material. In addition, certain types of abrasive tumbling processes may be suitable for harder lens material, such as glass or polymethylmethacrylate (PMMA), but may not be suitable for softer lens material, such as Silicone RMX-3 or RMX-3UV. Therefore, a need exists for a suitable process for removing flash from molded lens bodies made of a relatively soft lens material, such as Silicone RMX-3 or RMX-3UV.

SUMMARY OF THE DISCLOSURE

The present invention relates to manufacturing processes for intraocular lenses (IOLs), tumbling processes used in the manufacture of molded IOLs and IOLs manufactured with such processes. According to an embodiment of the invention, a process for removing flash from a molded silicone IOL involves a step of tumbling the IOL in a tumbling medium designed to be suitable for soft lens body materials. The tumbling process utilizes glass beads which are preconditioned for purposes of tumbling.

According to a preferred embodiment, the lens is tumbled in a mixture of glass beads of first and second diameters, e.g., 0.5 mm and 0.3 mm diameter glass beads in a FIG. 8 tumbler. Beads with diameter 0.5 mm are used to tumble single piece lens and beads with diameter 0.5 mm and 0.3 mm are used to tumble multipiece lens. The tumbling mixture also includes alcohol and deionized water. A quantity of lenses which has been initially cleaned of heavy flash in the corner of the haptic area and on the lens periphery for multipiece and single piece (edge only) lenses are placed in the tumbling mixture and are tumbled at approximately 80 rpms for approximately 72 hours. Then, additional alcohol is added. The tumbling process continues to run at approximately the same rpms for an additional 3 hours. Then, the tumbling machine is stopped. The lenses are separated from the tumbling medium, are soaked in alcohol and are ultrasonically cleaned. By this process, lenses made with soft lens body material may be manufactured using a tumbling process for removing additional flash around haptic connection area and the lens peripheral surface. As a result, a reduction of the time required to remove flash from a soft lens body is achievable.

Prior to tumbling the lenses, the glass beads are preconditioned in a preconditioning solution and purified water. The preconditioning solution is a mixture of aluminum oxide, purified water and glycerin. The beads are also reconditioned for reuse in tumbling. The beads are reconditioned in a manner similar to the manner for preconditioning.

BRIEF DESCRIPTION OF THE DRAWINGS

The detailed description of embodiments of the invention will be made with reference to the accompanying drawings, wherein like numerals designate corresponding parts in the several figures.

FIG. 1 is a prospective view of a multipiece molded lens body with excess material or flash.

FIG. 2 is a schematic view of a lens and tumbling media in a tumbling container.

FIG. 3 is a prospective view of a single piece molded lens body with excess material or flash.

DETAILED DESCRIPTION OF THE PREFERRED EMBODIMENTS

Figure 4:
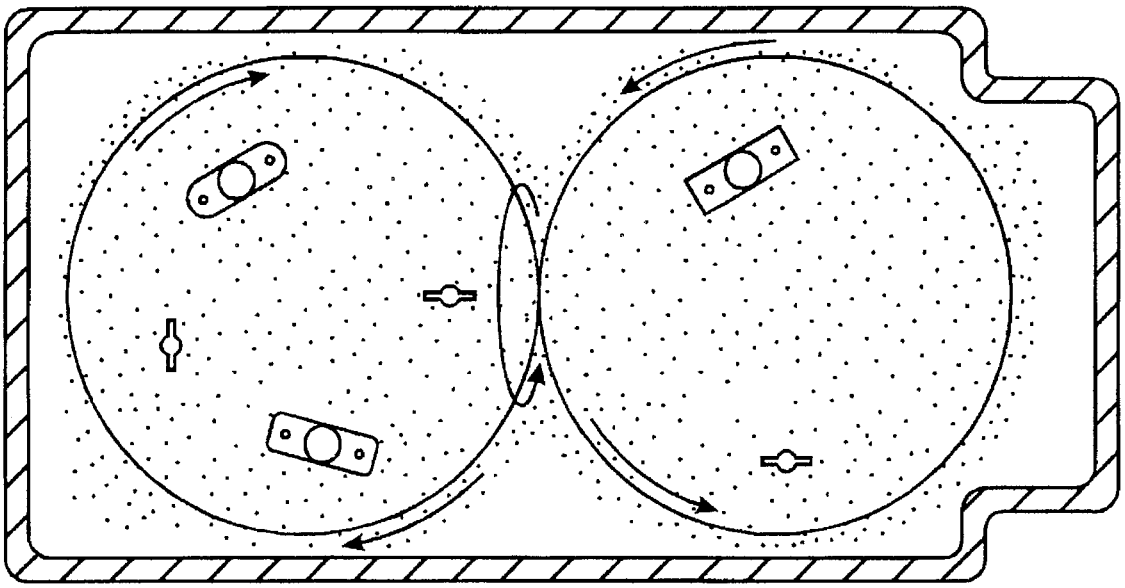
FIG. 4 is a cross section of a figure eight tumbler.

The following detailed description is of the best presently contemplated mode of carrying out the invention. This description is not to be taken in a limiting sense, but is made merely for the purpose of illustrating general principles of embodiments of the invention. The scope of the invention is best defined by the appended claims.

The present invention relates to manufacturing processes for intraocular lenses (IOLS), tumbling processes used in the manufacture of molded IOLS and IOLS manufactured with such processes. According to embodiments of the invention, an IOL is manufactured according to a process which includes a molding step for forming a rough lens body, a flash-removing step for removing flash and rough surfaces from the molded lens body and a lens body cleaning step. According to embodiments of the invention, these steps are designed to be particularly well-suit for manufacturing IOLS having relatively soft, flexible lens bodies, such as made from silicone, RMX-3 and RMX-3UV. These steps allow an improved practical use of tumbling processes in the manufacture of soft, flexible lens bodies.

A lens body is molded by providing a suitable lens body material. The molding process can be accomplished according to conventional impact molding processes or compression, injection or transfer molding.

As a result of the molding process, excess material or flash 12 is formed around the periphery of the rough lens body 10, as shown in FIG. 1 and FIG. 3. Haptic elements 14 and 16 may be molded with or otherwise attached to the lens body at connection locations 18 and 20, respectively. In the past, removal of flash from a lens body, especially around the Haptic connection areas 18 and 20, has been relatively time-consuming and expensive.

According to embodiments of the present invention, a tumbling process designed to be compatible with soft silicone lens bodies is employed to remove excess flash. Prior to the tumbling process, heavy flash build-ups, such as around the haptic connection areas 18 and 20, or at the periphery of multipiece and single piece lenses are removed, e.g., with a blade and/or tweezers. The lens body is then placed in a tumbling container 22 (FIG. 2) having a tumbling media 24 therein. The tumbling media 24, according to embodiments of the invention, is designed to be compatible with soft silicone lens material. In particular, the tumbling media comprises a plurality of glass beads of first and second diameters, alcohol and deionized water. It has been found that the use of two different-sized glass beads with the alcohol and water solution will provide a suitable media for tumbling lenses made of soft lens material.

In one embodiment, the glass beads comprise a plurality of glass beads having a one-millimeter diameter and a second plurality of glass beads, having a 0.5 millimeter diameter. An example of the relative volumes of media components, according to a preferred embodiment for sample rotational tumbling is as follows:

300 ml of 0.5 mm glass beads;
300 ml of 1.0 mm glass beads;
200 ml of pure Ethyl alcohol; and
20 ml of deionized water.

For figure eight rotational tumbling a high percentage of glass beads is required.

Approximately 40–50 lens bodies may be placed in a tumbling container 22 having the above composition (and component volumes) of tumbling media therein. The tumbling machine is run at 80 rpms. ±20 rpms. for approximately 72 hours ±5 hours (e.g., the tumbling container 22 is rotated in the direction of arrow 26 at approximately 80 rpms. for the above-noted time period). Then, the tumbling machine is stopped and approximately 50 milliliters of pure alcohol is added to the tumbling container 22. Then the tumbling machine is started again to run at approximately the same rpms. for approximately 3 hours. After the three-hour run, the tumbling machine is stopped and the lenses are separated from the tumbling media. For the figure eight (multiple rotational axes) tumbling, a different speed and duration will apply.

The lenses are then subjected to a cleaning step, wherein the lenses are placed in a container of alcohol (an alcohol bath). In a preferred embodiment, the lenses and alcohol bath may be placed in an ultrasonic tank and cleaned, ultrasonically, for approximately twenty minutes.

In a preferred embodiment of the ultrasonic cleaning, 60 ml of isopropyl alcohol (IPA) is placed in a beaker containing a maximum of 50 lenses and sonicated for 20 minutes. The IPA is then decanted and 60 ml of new IPA is added and sonicated for 15 minutes. The IPA is again decanted and 40 ml of new IPA is added.

As a result of the above process, a lens body may be manufactured having relatively smooth surfaces and having minimal or no flash remnants. Moreover, the above process is particularly well-suited for soft lens material which, heretofore, could not ordinarily be subjected to tumbling operations without severe damage to the soft lens material.

The above manufacturing steps and tumbling steps are particularly well-suited for soft IOL lens bodies, but may be used in the manufacture of other types of lens bodies as well. A soft-bodied IOL, e.g., made of silicone RMX-3 and RMX-3UV, can be manufactured according to the above-noted process, relatively economically, since the flash removal step is made much less labor-intensive by the unique tumbling process. When a tumbling process is employed in the manufacture of lens bodies having haptic elements connected thereto, it is desireable to reinforce the haptic connections. Examples of haptic reenforcements are described in the co-filed and commonly assigned United States Patent Application titled Improved Haptic Element Connections And Intraocular Lenses filed by U.S. Express Mail No. GB205010135 (incorporated herein by reference).

Various aspects of the above manufacturing stems and tumbling steps are particularly well-suited for single piece and multi-piece UV and non-UV silicone soft IOL lens. In a further preferred embodiment for tumbling (grinding) such single piece IOL lenses, a tumbling solution, comprising about 91% absolute alcohol and 9% purified water, is mixed with approximately 1300 grams of conditioned (as discussed below) glass beads of 0.5 mm diameter in a 1000 mL polyethylene jar. About 100–300 soft IOL lens bodies are placed in the jar for tumbling. The tumbling process is carried out in a figure-8 tumbler at 62 RPM for approximately 48 hours.

Although multiple lenses may be tumbled together, in preferred embodiments, a 2 diopter difference between groups of lenses exists. For instance, lenses with the following diopters may be tumbled together: 10.0 and 12.0 ; 16.5 and 18.5 ; 24.0 and 26.0. In contrast, lenses with the following diopters are preferably not tumbled together: 10.0 and 11.0 ; 21.0 , 22.0 and 23.5. In addition to the above list, lenses with the same diopter should not be tumbled together.

As noted above, the glass beads are conditioned prior to being added to the tumbling container. The preconditioning of the beads is carried out in order to smooth the otherwise relatively rough surfaces of the beads, yet provide the beads with sufficient abrasiveness to remove excess flash from the IOL lens bodies during the tumbling process. This provides significant benefits in the manufacture of soft IOL lenses, in that the relatively soft silicone material used in the lens body of such lenses can be easily scratched or marred by overly abrasive beads, while non-abrasive beads may not provide sufficient flash removal. It is noted that pre-conditioned beads as discussed herein provide the above mentioned benefits and also remove material from the optical surface, therefore, rendering the IOL's radius of curvature slightly smaller, causing an upward shift in diopter.

According to one embodiment, bead pre-conditioning steps comprise a five day cycle. In particular, the beads are tumbled (preferably in a "figure eight" tumbler, such as shown in FIG. 4) in a mixture of diatomaceous earth and IPA for approximately 3 days. Then the beads are subjected to two approximately 24-hours cycles of rinsing in IPA. Next, the beads are tumbled in a mixture of aluminum oxide and IPA for approximately 6 hours. This pre-conditioning process applies a layer of aluminum oxide on the glass beads and renders the beads abrasive to the desired degree for tumble processing soft IOL lens bodies.

The beads, after being pre-conditioned, are then suitable for approximately three separate IOL tumbling processes, e.g., in a figure-8 tumbler for approximately 48hours per tumbling process, as discussed above. Following the three separate IOL tumbling processes, the beads may be re-conditioned in the same manner as discussed above with respect to the pre-conditioned steps. The use of a figure-8 tumbler provides significant benefits in that the rotation about multiple rotation axes (as in a figure-8 tumbler) increases the occurrences and angles of engagement of the beads with the lens bodies.

A further embodiment of pre-conditioning for glass beads used to tumble (grind) silicone intraocular lenses includes three general processes, namely preparing the conditioning solution or agent, preconditioning the beads and cleaning the beads.

In preferred embodiments, the conditioning solution or agent consists essentially of the following ingredients for a 2000 gm quantity: 528 gm (26.40%) of aluminum oxide type 721; 151 gm (7.54%) purified water, (WFI), USP; and 1321 gm (66.06%) glycerin, USP. Initially, the water is heated to 70° C. Next, the water is stirred and ⅓ of the glycerin is added approximately every 5 minutes. While continuing to stir the aluminum oxide powder is slowly added until a homogeneous paste is formed. The solution is then allowed to mix for a minimum of 1 hour.

After the conditioning solution or agent is prepared the tumbler is set at 62 RPMs. A clean 1000 ml polyethylene jar is prepared and the following ingredients are then placed into the jar: 1300 gm of unconditioned 0.0.5 mm glass beads or 1200 gm of a combination of 800 gm of 0.5 mm and 400 gm of 0.3 mm unconditioned glass beads; 300 gm of conditioning solution or agent; and 150 gm of purified water. The lid is secured on the jar and the jar is placed in the tumbling machine. The tumbler is allowed to run for 48 hours.

Once the tumbling cycle is complete, the jar is removed and its contents are poured into a #60 sieve. The beads are then rinsed with purified water until the water comes out of the sieve slightly cloudly. The beads are then poured into an aluminum pan and dried at 120° C. in a drying oven for 10 hours.

After the beads have been dried they are poured into a series of sieves and a catch pan. The sieves and catch pan are specifically ordered top to bottom as follows: #40, #60 and a catch pan. The beads are poured into the top sieve.

Once the beads are poured into the top sieve, the top sieve is covered and the series of sieves are placed onto the vaulty, or shaking, machine and shaken for about 10 minutes. At the conclusion of the shaking, the sieves are dissembled. The contents of each sieve is emptied into an appropriate bead size container. The beads collected in the catch pan are discarded. Beads are inspected microscopically. Only beads with a thin film of aluminum oxide are used for tumbling the silicone IOLs.

Re-conditioning of previously used beads may be similar to the steps employed during pre-conditioning. However, in preferred embodiments, some differences in the process do exist. These differences are enumerated below.

In preferred embodiments, 2000 gm of the reconditioning solution or agent, for reconditioning of glass beads, consists essentially of the following ingredients: 1000 gm (50%) glycerin, USP; 400 gm (20%) aluminum oxide type 721; 300 gm (15%) IPA; and 300 gm (15%) purified water, WFI.

The water, IPA and glycerin are stirred together until a homogenous solution develops. One third of the aluminum oxide is then added about every 10 minutes while stirring. The solution is allowed to mix for a minimum of 1 hour or until the solution becomes completely homogenous.

In the bead reconditioning step, the following components are placed in the 1000 ml polyethylene jar: 1300gm of previously used (3 times) 0.5 mm glass beads, or 1200gm of a combination of 800 gm of previously used (3 times) 0.5 mm glass beads and 400 gm of previously used (3 times) 0.3 mm glass beads; 204 gm reconditioning solution or agent; 102 gm purified water; and 102 gm IPA. The jar with the above solution is tumbled for 8 hours. In the preferred embodiment, the glass beads should not be used in a lens tumbling process more than twice before reconditioning.

The bead cleaning step is as described above for pretreatment of beads. The acceptance criteria for use in tumbling is also as stated above.

The above described conditioning and reconditioning of the beads is advantageous in that it results in beads with an abrasive quality. The use of glycerin in the preconditioning process has been found to improve the quality of the abrasive coating. The abrasive quality is advantageous during lens tumbling in that it improves flash removal and the general lens condition.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being illustrated by the appended claims, rather than the foregoing description, and all changes which come within the meaning and range of equivalency of the claims are therefore intended to be embraced therein.

What is claimed is:

1. A method for preconditioning glass beads used for tumbling (grinding) a silicone lens body, the method comprising the steps of:

forming a conditioning agent composed of aluminum oxide, water and glycerin;

placing the glass beads and conditioning agent in a container;

tumbling the container of glass beads and conditioning agent with a tumbling machine for a period of time sufficient to coat the beads with aluminum oxide; and cleaning the coated beads after the tumbling step is complete.

2. A method as claimed in claim 1, wherein the aluminum oxide is approximately 26.4% by weight of the conditioning agent.

3. A method as claimed in claim 1, wherein the water is approximately 7.5% by weight of the conditioning agent.

4. A method as claimed in claim 1, wherein the glycerin is approximately 66% by weight of the conditioning agent.

5. A method as claimed in claim 1, wherein approximately 300 gm of conditioning agent is placed in the container with the glass beads.

6. A method as claimed in claim 1, wherein approximately 150 gm of water is placed in the container with the glass beads and the conditioning agent.

7. A method for preconditioning glass beads used for tumbling (grinding) a silicone lens body, the method comprising the steps of:

heating water to 70° C.; stirring glycerin into the water, wherein ⅓ of the total quantity of glycerin is added at timed intervals;

stirring and adding aluminum oxide powder until a homogeneous paste results;

allowing the solution to mix for minimum of 1 hour;

cleaning a 1000 ml polyethylene jar;

placing a seal around the threads of the jar;

adding unconditioned glass beads, conditioning solution or agent and water in the jar;

placing the jar on the tumbling machine;

running the tumbling machine with the jar of glass beads and conditioning agent for a period of time sufficient to coat the beads with aluminum oxide;

pouring the mixture from the jar into a sieve;

rinsing the beads with water;

drying the beads in a drying oven;

pouring the beads into a #40, #60 sieve and a catch pan; and shaking the beads in the sieves on a vaulty or shaking machine.

8. A method as claimed in claim 7, wherein the water is approximately 7.5% by weight of the conditioning solution or agent.

9. A method as claimed in claim 7, wherein the glycerin is approximately 66% by weight of the conditioning solution or agent.

10. A method as claimed in claim 7, wherein the aluminum oxide is approximately 26.4% by weight of the conditioning solution or agent.

11. A method as claimed in claim 7, wherein approximately 300 gm of conditioning solution or agent is placed in the jar with the glass beads.

12. A method as claimed in claim 7, wherein approximately 150 gm of water is placed in the jar with the glass beads and the conditioning solution or agent.

13. A method for reconditioning previously coated glass beads used to tumble (grind) a silicone lens body, the method comprising the steps of:

forming a reconditioning agent composed of glycerin, aluminum oxide, isopropyl alcohol and water;

placing the glass beads and reconditioning agent, in a container;

tumbling the container of glass beads and conditioning agent with a tumbling machine for a period of time sufficient to recoat the beads with aluminum oxide; and cleaning the beads after the tumbling step is complete.

14. A method as claimed in claim 13, wherein the glycerin is approximately 50% by weight of the reconditioning agent.

15. A method as claimed in claim 13, wherein the aluminum oxide is approximately 20% by weight of the reconditioning agent.

16. A method as claimed in claim 13, wherein the isopropyl alcohol is approximately 15% by weight of the reconditioning agent.

17. A method as claimed in claim 13, wherein the water is approximately 15% by weight of the reconditioning agent.

18. A method as claimed in claim 13, wherein approximately 204 gm of reconditioning agent is placed in the container with the glass beads.

19. A method as claimed in claim 13, wherein approximately 102 gm of water is placed in the container with glass beads and the reconditioning agent.

20. A method as claimed in claim 13, wherein approximately 102 gm of isopropyl alcohol is placed in the container with the glass beads and the reconditioning agent.

21. A method for reconditioning used glass beads used to tumble (grind) a silicone lens body, the method comprising the steps of:

stirring water, isopropyl alcohol and glycerin to form a homogeneous solution;

stirring aluminum oxide into the solution, wherein ⅓ of the total quantity of aluminum oxide is added at timed intervals;

allowing the water, isopropyl alcohol, glycerin and aluminum oxide solution to mix for a minimum of 1 hour or until it becomes completely homogeneous;

cleaning a 1000 ml polyethylene jar;

placing a seal around the threads of the jar;

adding used glass beads, reconditioning solution or agent, water and isopropyl alcohol in the jar;

placing the jar on a tumbling machine;

running the tumbling machine with the jar of glass beads and conditioning agent for a period of time sufficient to coat the beads with aluminum oxide;

pouring the mixture from the jar into a sieve;

rinsing the coated beads with water;

drying the beads in a drying oven;

pouring the beads into a #40, #60 sieve and a catch pan; and shaking the beads in the sieves on a vaulty or shaking machine.

22. A method as claimed in claim 21, wherein the glycerin is approximately 50% by weight of the conditioning solution or agent.

23. A method as claimed in claim 21, wherein the aluminum oxide is approximately 20% by weight of the conditioning solution or agent.

24. A method as claimed in claim 21, wherein the isopropyl alcohol is approximately 15% by weight of the conditioning solution or agent.

25. A method as claimed in claim 21, wherein the water is approximately 15% by weight of the conditioning solution or agent.

26. A method as claimed in claim 21, wherein approximately 204 gm of reconditioning solution or agent is placed in the jar with the glass beads.

27. A method as claimed in claim 21, wherein approximately 102 gm of water is placed in the jar with the glass beads and the reconditioning solution or agent.

28. A method as claimed in claim 21, wherein approximately 102 gm of iospropyl alcohol is placed in the jar with the glass beads and the reconditioning solution or agent.

* * * * *